United States Patent [19]

Continenza et al.

[11] 4,396,174

[45] Aug. 2, 1983

[54] CONTAINER SUPPORT

[76] Inventors: Ralph R. Continenza, 3647 Roselawn, Woodmere Village; Dominic Federico, 5567 Mayfield Rd., Lyndhurst, both of Ohio 44124

[21] Appl. No.: 352,800

[22] Filed: Feb. 26, 1982

[51] Int. Cl.[3] ..... E06C 7/14

[52] U.S. Cl. ..... 248/211; 248/312.1

[58] Field of Search ..... 248/210, 211, 238, 146, 248/312.1, 311.2

[56] References Cited

U.S. PATENT DOCUMENTS

| | | | |
|---|---|---|---|
| 1,200,936 | 10/1916 | Hall | 248/210 |
| 1,593,043 | 7/1926 | Stroecker | 248/312.1 X |
| 2,508,258 | 5/1950 | Heinrich | 248/211 UX |
| 2,524,875 | 10/1950 | Beaver | 248/211 |
| 2,542,737 | 2/1951 | Vogel | 248/211 X |
| 2,645,443 | 7/1953 | Pelletier | 248/211 |
| 2,993,672 | 7/1961 | Bower et al. | 248/312.1 X |
| 4,120,472 | 10/1978 | Balne | 248/211 |

*Primary Examiner*—J. Franklin Foss

*Attorney, Agent, or Firm*—Henry Kozak

[57] ABSTRACT

Container support means is provided for ready attachment to a ladder for securely supporting a paint can or like container of various sizes in readily accessible position. It permits attachment of the container to either side of a ladder.

5 Claims, 11 Drawing Figures

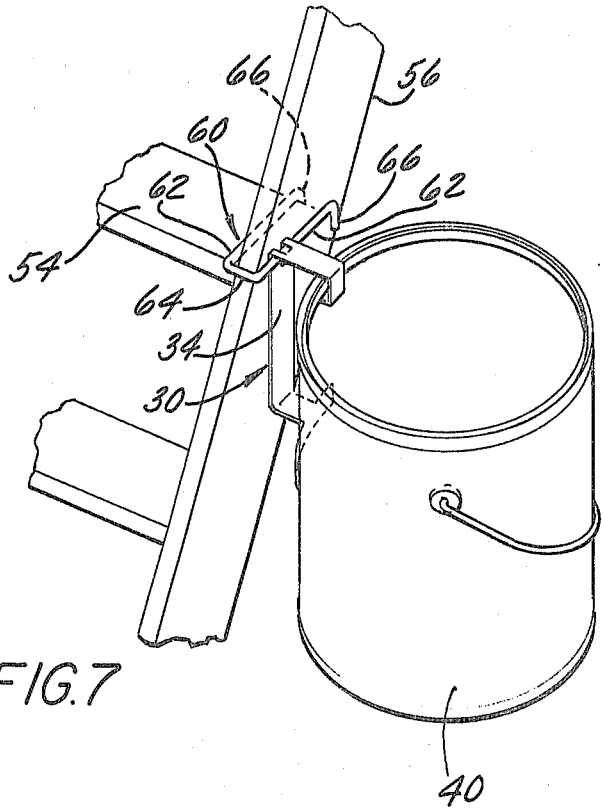
FIG. 7
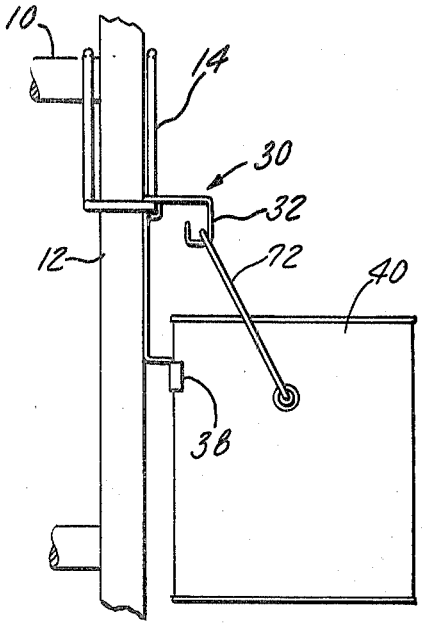
FIG. 11
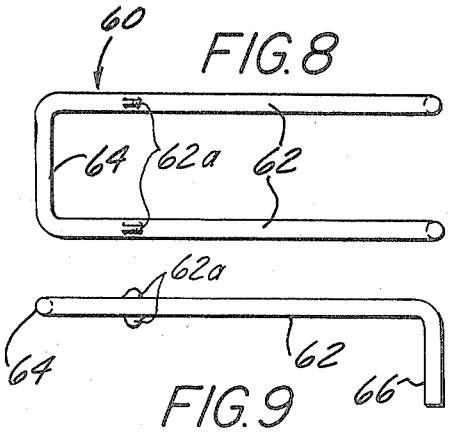
FIG. 8
FIG. 9
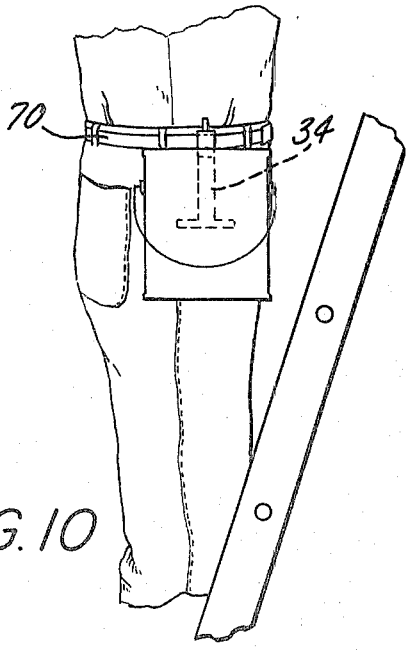
FIG. 10

CONTAINER SUPPORT

BACKGROUND OF THE INVENTION

The matter of conveniently securing a container such as a paint can to a ladder in readily accessible position has been a longstanding problem confronting painters. Many forms of attachments and brackets have been devised in the attempt to provide a satisfactory solution to the problem. However, many are too costly to be commercially feasible. Some are too complex and impractical for use with a can containing paint or similar substance. Others lack versatility in that their use is restricted to only one side of the ladder.

It is apparent that there exists a need for container support means which will effectively secure the container of a quart or gallon size to a ladder of the round rung, flat or various step type at any desired point thereon.

SUMMARY OF THE INVENTION

This invention relates to simple and effective container support means comprising a hanger for gripping the container and a securement member operatively connected to the hanger for supporting the hanger at a desired point on a ladder. The hanger is formed with a hook-shaped portion at its upper end which is adapted for interlocking engagement with the usual annular rib or lip at the tip of a paint can. The hanger has an elongated portion which depends from the hook-shaped portion so as to be disposed at the side of the container. At its lower end the hanger is provided with curved laterally extending arms for embracing the side of the can. At its upper end the hanger is provided with an eye portion by means of which the hanger is operatively connected to the securement member. The securement member is preferably formed of heavy gauge rod or wire and is U-shaped in plan view with each leg having a straight section terminating in a hook adapted for attachment to the round rung of a ladder. To connect the hanger to the securement member the end of one of the legs is inserted through the eye portion of the hanger until the eye is on the straight section of the leg. The securement member is then attached to a ladder by connecting one hook thereof to the ladder rung at a point adjacent the inner face of a side rail of the ladder, the other hook being disposed adjacent the outer face of the side rail. Thus the securement member is in embracing relationship with the side rail, the base of the U engaging the front face of the rail and straight sections of the legs disposed in substantially horizontal position along the side faces of the rail. Moreover, the hanger may be moved to a position in which it hangs from the legs along the inner or outer face of the side rail. In either location the elongated portion of the hanger will bear against a side face of the rail, thereby maintaining the container in upright or vertical position.

For supporting a container on a ladder having flat steps the securement member is of simple U shape with the end of each leg bent downwardly at right angles to the plane of the member. This member is mounted on the ladder with one leg resting on a step at a point adjacent the inner face of a side rail, the other leg engaging the outer face of the rail. A wedging engagement exists between the legs and the side rail to hold the member securely in place. In addition, the downwardly bent end of the leg disposed along the inner face of the side rail extends into overlapping relationship with the step to preclude forward shifting of the member. In this embodiment of the invention, the hanger is connected to the leg disposed at the outer face of the side rail, with the elongated portion of the hanger bearing against the rail outer face.

The various features and advantages of the invention will be apparent from the following description taken in conjunction with the drawings.

BRIEF DESCRIPTION OF THE DRAWINGS

FIG. 7 is perspective view of an embodiment of the invention applied to a ladder having flat steps.

FIG. 8 is a plan view of the securement member shown in FIG. 7.

FIG. 9 is a side view of the securement member shown in FIG. 8.

FIG. 10 is a view of the hanger shown in FIG. 6 connected to the belt of a workman for supporting a container.

FIG. 11 is an elevational view showing a container connected to the hanger member by means of the carrying handle.

DETAILED DESCRIPTION

Figure 1:
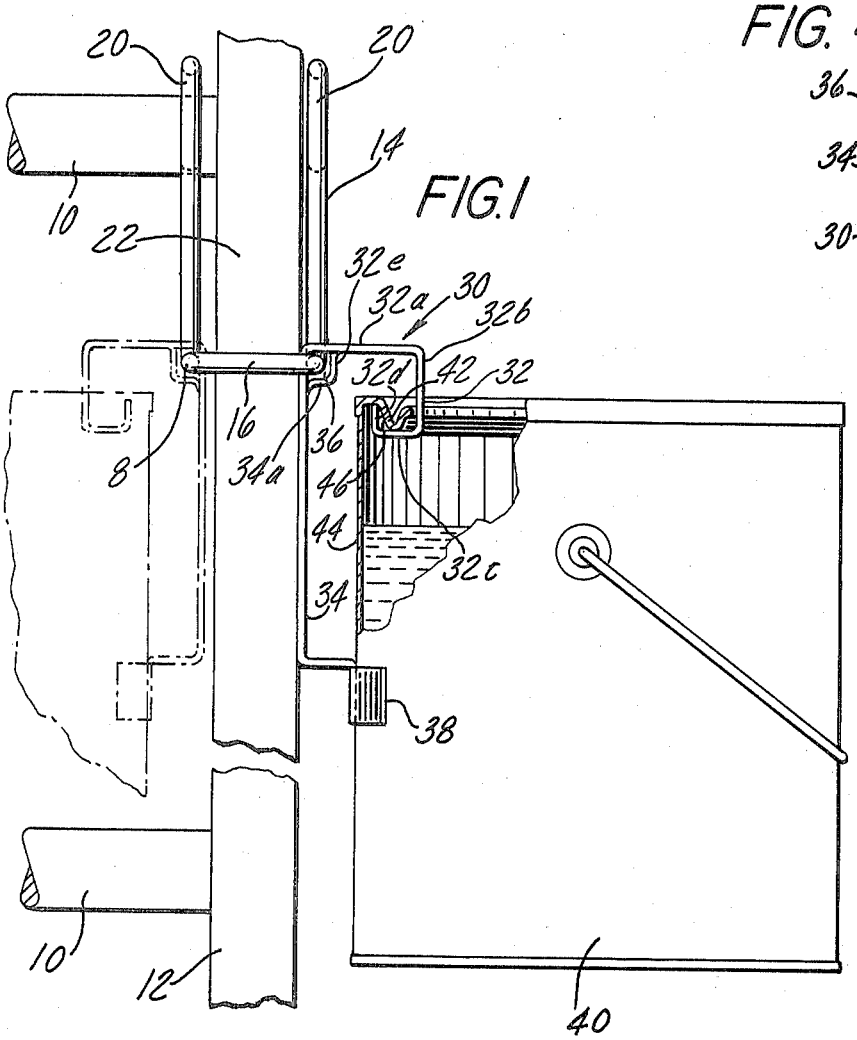
FIG. 1 is an elevational view partly in section showing an embodiment of the invention applied to a ladder of the round rung type.

Referring to FIG. 1 of the drawings there is shown a ladder of the type having round or cylindrical rungs having their ends affixed to side rail 12. Connected to one of the rungs 10 is a securement member 14 preferably formed of a length of heavy gauge rod or wire. Member 14 is generally of U-shape and comprises a base 16 and parallel legs 18 adapted to embrace rail 12. Extending upwardly from each leg 18 is a hook 20 for connection to rung 10. Hooks 20 are of identical configuration and lie in parallel planes containing legs 18. This dual-hook arrangement permits use of the invention on either the outside or inside of the ladder side rail 12 as is evident from FIG. 1. Moreover, the invention is applicable to the right hand or left hand side of the ladder. It will be observed in FIG. 1 that securement member 14 is securely held in place by inner hook 20 and by base 16 which bears against the forward face 22 of rail 12. It is clear that other hook 20 adjacent the outer face of the rail is not in engagement with the rung but it effectively serves the function of precluding disengagement of hanger 30 from member 14 as will be hereinafter explained. The curvature of hooks 20 may of course be made of any desired radius so long as sufficient overlap with the rung is obtained. It is to be noted that legs 18 and hooks 20 are so arranged that when a ladder is medially inclined against a wall the legs are disposed horizontally as in FIG. 5.

Figure 4:
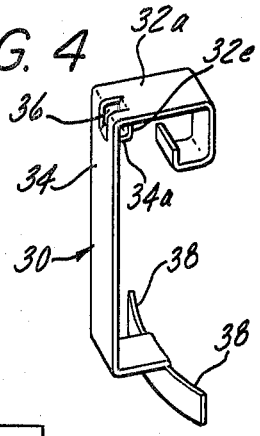
FIG. 4 is a perspective view of the hanger member embodying the invention.
Figure 2:
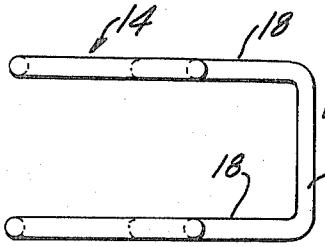
FIG. 2 is a plan view of the securement member shown in FIG. 1.
Figure 5:
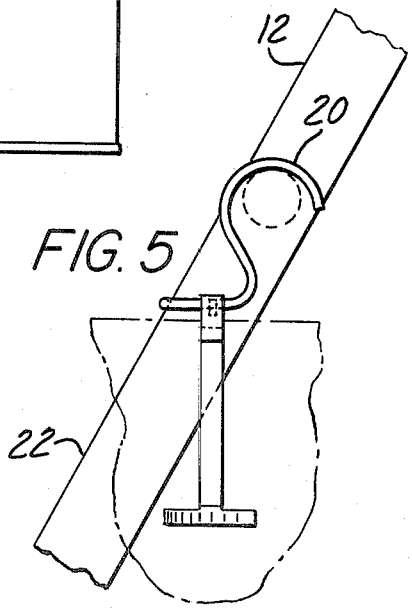
FIG. 5 is a side view of the embodiment shown in FIG. 1.
Figure 3:
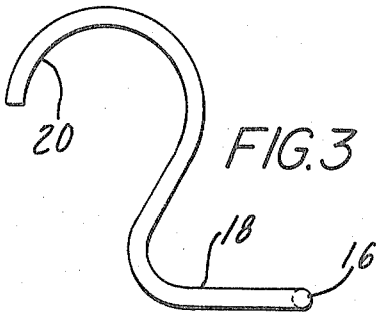
FIG. 3 is a side view of the securement member shown in FIG. 2.

Cooperating with support member 14 is hanger 30 which comprises a hook-shaped portion 32 having a horizontal web **32*a*. An elongated flat body 34 depends from the inner end of the web and is adapted for engagement with the side rail on a ladder as in FIG. 1. Hook 32 comprises a downward extension 32***b*, horizontal inward arm 32*c* and upwardly extending legs 32*d*. Hook 32 is adapted to interlock with the upper end of a container such as a paint can 40 which is formed at its open end with an annular rib 42 spaced inwardly from side wall 44 to form an annular channel 46 within the can. Leg 32*d* is adapted to be received in channel 46 between rib 42 and wall 44, thereby precluding any possibility of the can becoming disengaged from the hanger. Preferably rib 42 bears against arm 32*c* although engagment may simultaneously occur between the top of leg 32*d* and the can. The distance between web 32*a* and the top of leg 32*d* is greater than the vertical dimension of rib 42 to permit passage of leg 32*d* beneath the rib when the hook is moved into interlocking engagement with the can. Inwardly of the juncture of web 32*a* and body 34 there is provided an eye 36 for receiving support member 14 to pivotally and slidably connect the member with hanger 30. Eye 36 comprises segment 34*a* of body 34 and segment 32*e* of web 32*a*. These segments are formed to the configuration shown in FIGS. 1 and 4 by a die and press operation well known in the art. As is clear from FIG. 4, eye 36 is formed by segments 32*e*, 34*a* and the adjacent portions of web 32*a* and body 34. Support member 14 is readily connected to hanger 30 by manipulating and end of one hook 20 through eye 36 until one of legs 18 is within the eye approximately as shown in FIG. 5, wherein body 34 will be in engagement with a side face of rail 12 when member 14 is mounted on rung 10. The lower end of body 34 is formed with a pair of convexly curved lateral arms 38 for embracing the side of a can. Arms 38 are spaced outwardly of body 34 an amount such that with the body in engagement with the side rail face, the can is held in vertical position. It will be understood that hanger 30 may be connected to member 14 at the inner or outer side of rail 12 by sliding the hanger along legs 18 and base 16 to the desired position. Also hanger 30 may be mounted so as to hang from base 16 in which location body 34 bears against forward face 22 of the rail.

Hanger 30 is preferably fabricated from a strip of sheet steel, which provides a safe and durable construction. However, other material of adequate strength may be used in the manufacture of the hanger.

Figure 6:
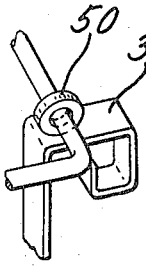
FIG. 6 is a perspective view of a modification of the hanger shown in FIG. 4.

In FIG. 6 there is shown a modified hanger having an eye 50 affixed to the top of web 32*a*. The hanger in other respects is identical with aforedescribed hanger shown in FIGS. 1, 4 and 5. Eye 50 cooperates with support member 14 to support a can in the same manner as eye 36 of the previous embodiment.

Referring to FIG. 7 there is shown an embodiment of the invention applied to a ladder having flat steps 54. The securement member 60 is of simple U-shape having parallel legs 62 joined by base 64. The ends 66 of the legs are bent downwardly at right angles to a plane containing the legs. Member 60 is preferably formed of heavy gauge rod or wire for adequate rigidity. The member is mounted on the ladder in embracing relationship with side rail 56, one leg 62 resting on step 54 at a point adjacent the inner face of the rail, and the other leg 62 engaging the outer face of the rail. A wedging or pinching engagement exists between legs 62 and the side rail to hold the member securely in place. In addition end 66 of the leg resting on step 54 extends downwardly into overlapping relationship with the rear face of the step to limit forward shifting of the member. In this embodiment hanger 30 is mounted on leg 62 which is disposed at the outer face of rail 56. As in the previous embodiment the hanger body 34 bears against the outer face of rail 56 to support a can in upright position. Each leg 62 is preferably crimped to provide protuberances as at 62*a*, a short distance from base 64 to resist shifting of hanger 30 toward base 64 and possible detachment of member 60 from the ladder.

In FIG. 10 there is shown a hanger suspended from the belt of a workman. In this use of the hanger, the belt 70 holds body 34 of the hanger against the workman's side and the can is securely held by the hanger as in the previous embodiments. The suspension of the container on the belt of a workman provides a convenient means for carrying paint or holding tools used by a workman while on a ladder.

In FIG. 11 there is shown the manner in which a container may be hung from hanger 30 by means of the usual bail or curved carrying handle 72. Handle 72 connects to hook-shaped portion 32, and arms 38 embrace the side of the container near the upper end thereof, as shown, to securely hold the container in upright position.

The terms and expressions employed are used as terms of description and not of limitation and there is no intention, in the use of such terms and expressions, of excluding any equivalents of the features shown and described or portions thereof, and it is recognized that various modifications are possible within the scope of the invention claimed.

What is claimed is:

1. Support means for connecting a container of the paint can type to a ladder, said means comprising a hanger having an integral hook-shaped portion at its upper end adapted for an interlocking attachment to the upper end of a container, said portion comprising a horizontal top web having an inner end, said hanger having a body porition depending from the inner end of said web and adapted to be disposed adjacent the outer side of the container, said body portion having at its lower end lateral arms for embracing the side of the container, and a securement member for attachment of said hanger to a ladder, said member comprising heavy gauge rod formed to a U-shaped configuration having a base joining a pair of spaced legs for embracing a side rail of the ladder, and means on said hanger for pivotally and slidably connecting said hanger to one of said legs, said last-named means comprising an eye formed closely adjacent the juncture of said web and said body portion for receiving one of said legs in slidable engagement therewith.

2. Support means as set forth in claim 1 wherein at least one of said legs is provided with a hook for attachment to a rung on the ladder.

3. Support means as set forth in claim 1 in which said eye is disposed on the top side of said web.

4. Support means as set forth in claim 1 wherein said hanger is formed from a flat strip of sheet metal and said eye is disposed inwardly of the juncture of said web and said body portion and is formed by segments of said web and said body portion.

5. A hanger member for attachment to the open end of a container of the paint can type having a depending annular rib spaced inwardly from the container side wall to form an annular channel, said member being formed of a flat strip of sheet metal and comprising a hook at its upper end for interlocking engagement with the rib of the container, said hook comprising a horizontal top web and a vertical body depending from the inner end of the web, said body having at its lower end lateral arms for embracing the outer side of the container, the juncture of said web and said body having an eye portion formed of segments of said body and said web, said eye portion being disposed beneath said web and adapted to receive a leg of an associated support member to pivotally and slidably connect the hanger to the member.

* * * * *